United States Patent [19]

Smith et al.

[11] Patent Number: 4,521,985

[45] Date of Patent: Jun. 11, 1985

[54] AMBIDEXTROUS GUN MAGAZINE RELEASE

[76] Inventors: Alan K. Smith, 211 Betty Dr.; Stephen R. Alexander, 814 Scottsdale Dr., both of Richardson, Tex. 75080

[21] Appl. No.: 494,864

[22] Filed: May 16, 1983

[51] Int. Cl.[3] ..... F41C 25/06

[52] U.S. Cl. ..... 42/7

[58] Field of Search ..... 42/7

[56] References Cited

U.S. PATENT DOCUMENTS

| | | | |
|---|---|---|---|
| 984,519 | 2/1911 | Browning | 42/7 |
| 1,397,109 | 11/1921 | Pedersen | 42/7 |
| 4,236,337 | 12/1980 | Beretta | 42/7 |
| 4,326,353 | 4/1982 | Ludwig et al. | 42/7 |
| 4,449,311 | 5/1984 | Giragosian | 42/7 |

FOREIGN PATENT DOCUMENTS

| | | | |
|---|---|---|---|
| 55913 | 10/1912 | Austria | 42/7 |
| 672094 | 2/1939 | Fed. Rep. of Germany | 42/7 |

*Primary Examiner*—Charles T. Jordan

*Attorney, Agent, or Firm*—Warren H. Kintzinger

[57] ABSTRACT

An ambidextrous release for gun magazines in a retrofit design is provided for Colt government model pistols and other similar design semi automatic pistols. The new magazine release catch has much of the basic configuration of the original equipment catch but instead of a solid catch it has a pivotal lever, with a cam surfaced catch on the end to engage the magazine, that is pivot pin mounted in the gun magazine catch lock release structure. The structure is lengthened to also extend outward beyond the gun right hand surface with a right side button on the right hand end. The magazine lock release right side button with proper manipulation combined with pressure from the other end and turning achieves dog projection release removal and, in reverse, installation thereof without requiring the use of a screw driver or any other tools. A simple dog slot extension is machined within the gun receiver to allow for installation and movement of the new magazine release catch. This permits movement of the lock tip, that holds the release catch assembly in the gun, through the receiver to the left. The machined cut does not in any way weaken the pistol or change the basic function of the pistol in a cut not visible from the pistol exterior.

23 Claims, 12 Drawing Figures

AMBIDEXTROUS GUN MAGAZINE RELEASE

Figure 1:
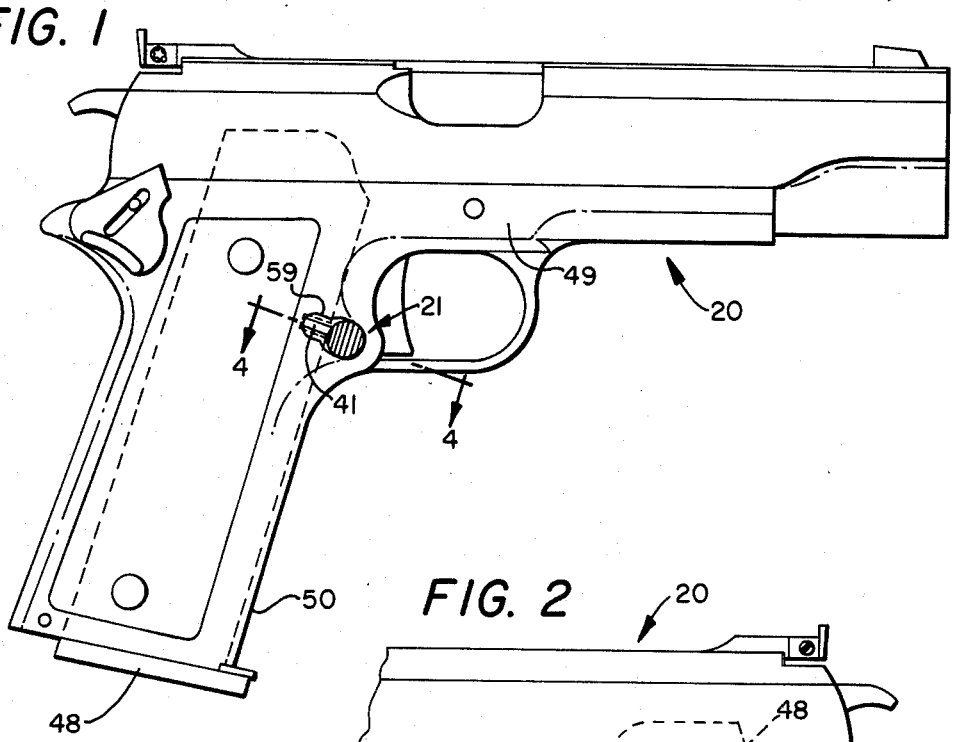

This invention relates in general to gun magazine release structures, and more particularly, to an ambidextrous magazine release for semi automatic pistols.

Magazine release structures for semi automatic pistols such as, for example, the Colt government model "45" pistol have generally had a push button activated catch lock release operated from the left side of the pistol. This for the right handed shooter is generally activated with the thumb of the right hand and, in doing so, the shooters grip on the butt of the gun is generally released or at least relaxed during magazine release for a clip change. This can result in loss of time and/or adversely affect continued shooting accuracy. Installation of a new improved ambidextrous magazine release permits easier one handed operation of the pistol at least in relation to releasing the magazine by either a right handed person or a left handed person. Various magazine clip change operation options are provided the pistol user optimizing piece use in target shooting both speed of use and accuracy that can also be important for law enforcement or military use.

It is therefore a principal object of this invention to provide an improved magazine release for a semi automatic pistol capable of operation from both the left and right sides of the pistol as a truly ambidextrous magazine release.

Another object is to provide such an ambidextrous magazine release that may be manually removed from the pistol without requiring the use of a screw driver or any other tools.

A further object is to achieve magazine release without relaxing or changing pistol grip for maintaining accuracy and optimized speed of shooting on the target range and elsewhere.

Still another object is to provide such a gun magazine release with magazine clip release and replacement quick and efficient for both the right handed person and the left handed person.

Features of the invention useful in accomplishing the above objects include, in an ambidextrous magazine release for semi automatic pistols, a release structure with a lever with a bevel surfaced magazine engaging catch on the end. The catch lever is pivot pin mounted in the gun magazine catch lock release structure. The structure is lengthened relative to other pre-existing magazine catch lock release units to also extend outward beyond the gun right hand surface and mounts a right side release button on the right hand end. The proper depression of both magazine lock release buttons along with counter clockwise turn manipulation of the right magazine release button achieves unlock positioning of a lock dog projection to permit magazine release structure removal and, in reverse, installation thereof without requiring the use of a screw driver or any other tools. A simple slot extension is machined within the pistol reciever to accomodate the lock dog projection of the magazine release structure in installation and actuation movement of magazine release. This actuation movement also, when from the right side of the gun, includes movement of the lock tip, that holds the release catch assembly in the gun, through the gun receiver to the left along a machine cut that does not in any way weaken the pistol or change the basic function of the pistol in a slot extension cut not visible from the pistol exterior.

Specific embodiments representing what are presently regarded as the best modes of carrying out the invention are illustrated in the accompanying drawings.

Figure 2:
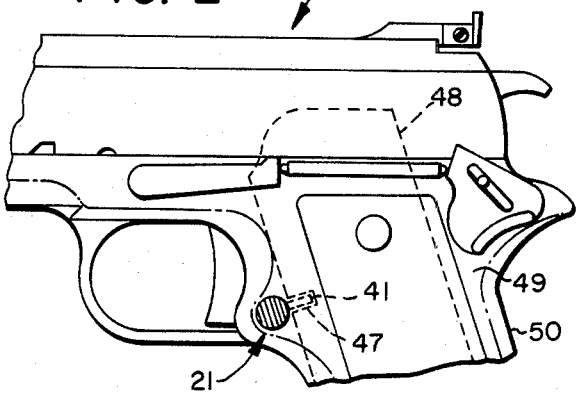
Figure 3:
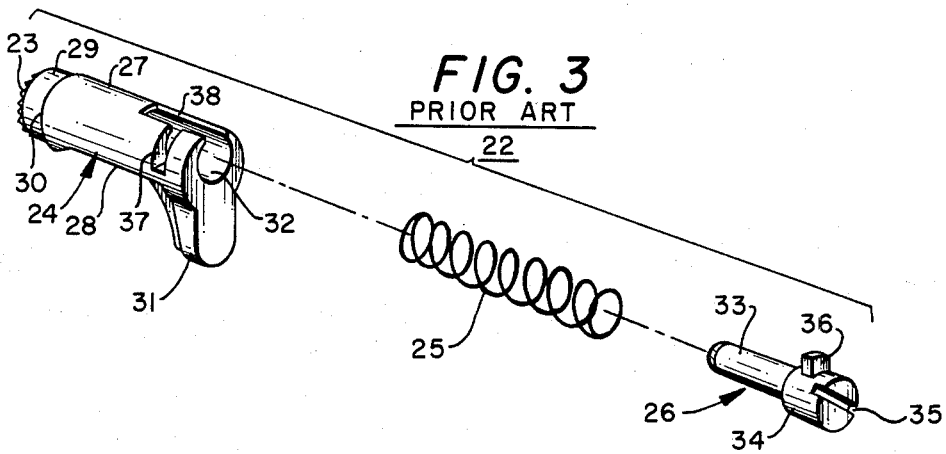
FIG. 3 PRIOR ART
Figure 4:
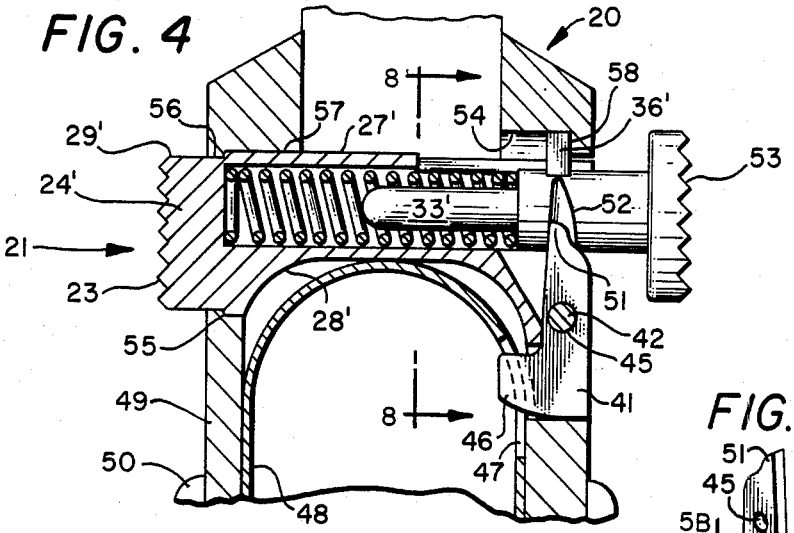
Figure 5A:
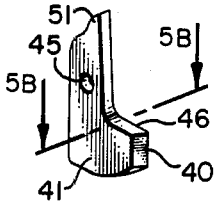
Figure 5:
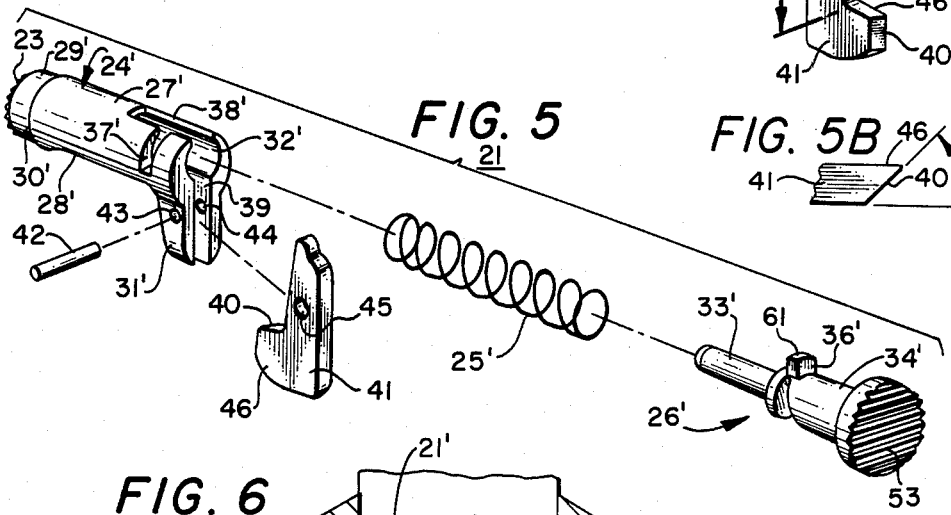
Figure 5B:
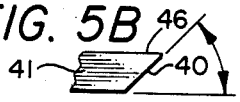
Figure 6:
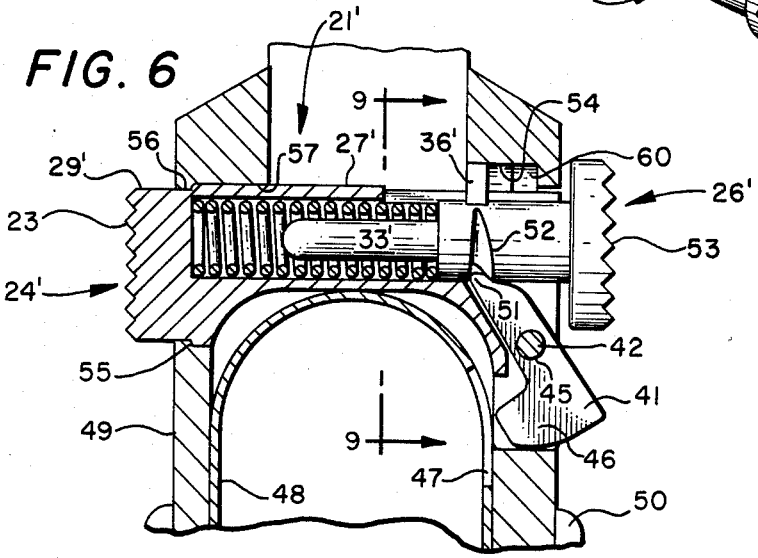
Figure 8:
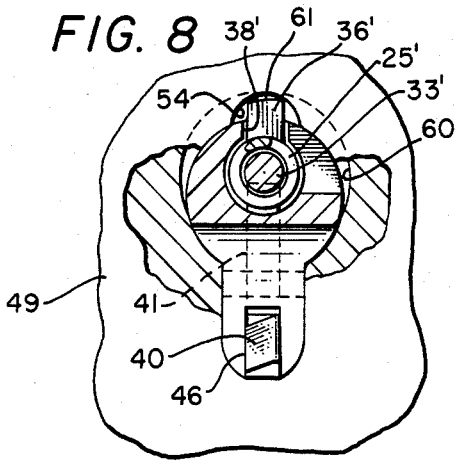
Figure 7:
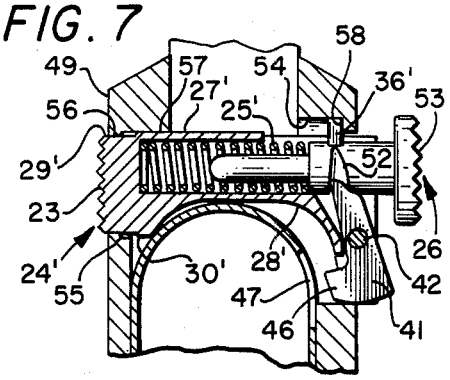
Figure 9:
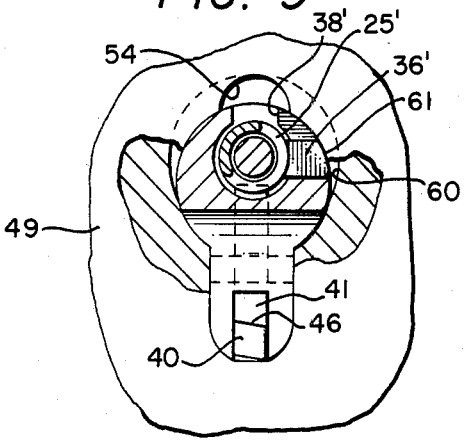
Figure 10:
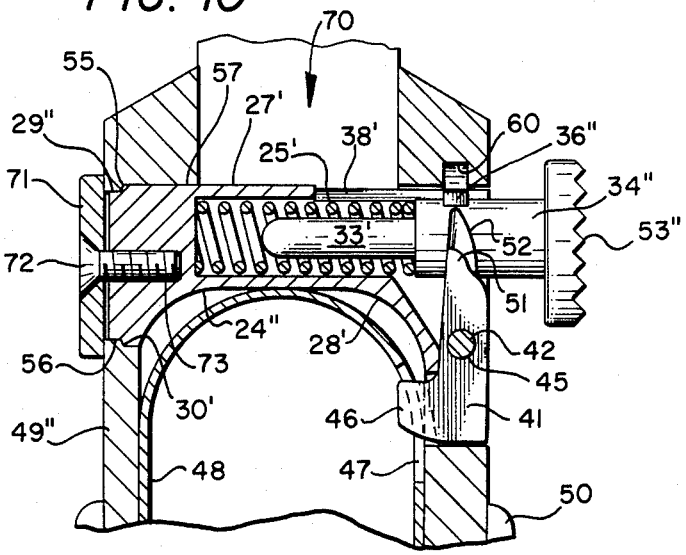

In the drawings:

FIG. 1 represents the right hand side elevation view of a Colt "45" semi automatic pistol with an ambidextrous gun magazine release retrofit;

FIG. 2, a partial left hand side elevation view of the pistol of FIG. 1;

FIG. 3, an exploded perspective view of a prior art pistol magazine catch, catch spring and catch lock release structure;

FIG. 4, a partially cut away and sectioned view taken generally along line 4—4 of FIG. 1 showing internal detail of the ambidextrous magazine release in a pistol receiver with its magazine catch locking a magazine clip in place;

FIG. 5, an exploded perspective view of the improved ambidextrous magazine release catch with the catch cammed locking lever and its pivot mounting pin, the catch lock with a right hand release actuation button, and the catch spring;

FIG. 5A, a reverse perspective view of the cammed locking lever from its showing in FIG. 5;

FIG. 5B, a partial view taken from line 5B—5B of FIG. 5A showing cam bevel detail of the cammed magazine locking lever;

FIG. 6, a partially cut away and sectioned view like that of FIG. 4 with, however, the right hand side magazine release button manually depressed for magazine release with the locking lever pivoted from the magazine catch engagement state of FIG. 4;

FIG. 7, a partially cut away and sectioned view like that of FIG. 4 with, however, the left hand side magazine release button manually depressed for magazine release with the locking lever moved from the magazine catch engagement state of FIG. 4;

FIG. 8, a partial cut away and sectioned view taken generally along line 8—8 of FIG. 4 showing additional internal detail of the ambidextrous magazine release in the magazine catch engaged state;

FIG. 9, a partial cut away and sectioned view taken along line 9—9 of FIG. 6 showing internal detail of the ambidextrous magazine release in the magazine catch disengaged state; and, FIG. 10, a partially cut away and sectioned view like that of FIG. 4, however, of gun magazine release retrofit for a pistol having a magazine release manual actuate button on the right hand side of the pistol instead of on the left hand side as has been standard heretofore.

Referring to the drawings:

The semi automatic piston 20 of FIGS. 1 and 2 is shown to be equipped with an improved ambidextrous magazine release 21 that is used in place of the prior art magazine release 22 of FIG. 3. Referring also to FIG. 4 the ambidextrous magazine release 21 is shown to have a left hand side magazine release actuate button 23 the same as the actuate button 23 of the prior art magazine release 22. Prior art magazine release 22 has pistol magazine catch body 24, that is the main body of release 22, a catch spring 25 and a catch lock release structure 26. The magazine catch body 24 has a round section 27 with a cut out 28 therein to provide clearance from the rounded front of a magazine when the release 22 is in place in a pistol and a smaller diameter button projection 29 extending out from shoulder 30. The magazine catch body 24 also has a magazine cam lock extension 31 and in transverse alignment therewith an eccentrically positioned opening 32, in body 24, receiving catch spring 25 and catch lock release structure 26. The catch lock release structure 26 has spring guide extension 33 from the larger diameter base 34 equipped with a screw driver slot 35 and a lock tip 36 extended outward therefrom. The lock tip 36 may be rotated to an unlock position in radially extended slot 37 in magazine catch body 24 where it does not extend out beyond the profile of the surface of the body 24 or to a receiver retaining lock state in alignment with longitudinal slot 38 in body 24 when it is a retainer element within an internal slot in the piston receiver. In this state magazine release movement is permitted with the magazine catch body 24 being manually pushed toward the right via pressure on button 23 lifting shoulder 30 off its seat in the receiver and against resilient compressive resistance of spring 25. Thus, the magazine cam lock extension 31 is moved out of holding engagement with a magazine for magazine release.

Description and understanding of the prior art magazine release 22 of FIG. 3 is helpful in distinguishing new features of the improved ambidextrous magazine release 21 of FIGS. 1, 2 and 4 through 9. As shown in FIGS. 4 and 5 the ambidextrous magazine release 21 has a pistol magazine catch body 24' much like the body 24 of the prior art unit of FIG. 3 with parts the same or similar in part given primed numbers and some description common to both is not repeated again as matter of convenience. The magazine cam lock extension 31' in this instance is a bifurcated extension with a slot 39 extended therethrough and to opening 32' in body 24' with the bifurcated extension 31' pivotally mounting a magazine cam 40 surfaced catch locking lever 41 in the slot 39. This is accomplished via a pivot pin 42, press fitted in openings 43 and 44 in the opposite sides of the bifurcated extension 31', that extends through lever opening 45 with the lever 41 pivotal on the pivot pin 42. Referring also to FIGS. 5A and 5B locking lever 41 has a lock paw 46 that in the magazine catch lock state of FIGS. 1, 2, 4 and 8 extends into the magazine lock slot 47 of a magazine 48 inserted into the pistol receiver 49 through the pistol grip 50. As a magazine 48 is being inserted into the pistol receiver 49 the sloped cam 40 surface cams the lever 41 pivoting around pin 42 out of the way with the lever tip 51 pushing catch lock release structure 26' to the left against the resilient compressive force of catch spring 25'. Then when the lock paw 46 of lever 41 comes into alignment with the magazine lock slot 47 the resilient compressive force of catch spring 25' snaps it into the lock slot 47 in a magazine catch lock action.

The tip 51 of lever 41 extends into a groove 52 cut in the base portion 34' of the catch lock release structure 26' with sufficient clearance to accomodate the different relative operational position states of the lever 41 and the catch lock release structure 26'. In addition to the lever 41 being cammed counter clockwise upon insertion of a magazine 48 and moving catch lock release structure 26' to the left against the force of spring 25' the lever 41 may be moved counter clockwise by right hand side actuate button 53 being pushed inward to the left against the force of spring 25'. With sufficient movement of catch lock release structure 26' to the left lever 41 is rotated sufficiently as shown in FIG. 6 to remove lock paw 46 from the magazine lock slot 47 for release of a magazine 48. With this structure lock tip 36' must be permitted to move to the left from the position of FIG. 4 to a position as shown in FIG. 6. In order to accomodate such movement of lock tip 36' the gun receiver 49 must be provided with a small internal cut 54 machined therein as a retrofit of the basic pistol. The cut 54, not visible from the outside of the pistol with the magazine release in place, does not weaken the pistol and has no adverse effect on functioning of the pistol. Further, the cut 54 permits reinstallation of the original magazine catch with no change in pistol appearance or function.

Shoulder 30' of magazine catch body 24' is seated on receiver shoulder 55 that prevents further movement of body 24' to the left with button projection 29' a free sliding fit in receiver opening 56 and round section 27' of body 24' a free sliding fit in receiver opening 57. Thus, when the left hand side magazine release actuate button 23 is pushed inward to the right against the resilient resistive force of spring 25', since lock tip 36' is held from movement to the right by cut wall 58 in receiver 49, the magazine catch body 24' is moved to the right carrying pivot pin 42 with it bodily to the right. This, bodily movement to the right is transmitted to lever 41 that also, since catch lock release structure 26' is restrained from movement to the right by lock tip 36' bearing against cut wall 58, imparts counter clockwise rotation of lever 41 about pin 42 to the state of FIG. 7. These combined movements move lever lock paw 46 from the magazine lock slot 47 for magazine 48 release. The bifurcated cam lock extension 31' and the body 24' are free sliding fits to the right from a key hole receiving opening 59 therefore in the right hand side of the pistol receiver 49 when the lock tip 36' is turned counter clockwise in slot 37' to within the profile of body 24'. It is this state for both removal of the ambidextrous magazine release 21 and reinsertion thereof from and into the pistol receiver 49. The proper depression of both magazine lock release buttons 23 and 53 along with counter clockwise turn manipulation of the right hand side magazine release button 53 achieves unlock positioning of a lock dog projection, i.e. lock tip 36', to permit magazine release structure removal and, in reverse, installation thereof without requiring the use of a screw driver or any other tools. This involves rotative movement of the lock tip 36' through the receiver radial segment groove 60 that is provided in the pistol receiver 49 in its original form from which the retrofit groove 54 extends. It should also be noted that the top 61 of lock tip 36' is curved and sloped to conform to the outer profile of the body 24' as is quite apparent in the rotated state of FIG. 9.

Please refer now to the alternate pistol magazine release retrofit embodiment of FIG. 10 having a magazine release manual actuate button 53'' on the right hand side of the pistol instead of on the left hand side as has been standard heretofore. This embodiment has many features in common with the ambidextrous pistol magazine release embodiment of FIGS. 1, 2 and 4 through 9 and as a result many of the component parts and features that are identical are numbered the same and those that are similar carry double primed identification numbers and where operation is duplicated description will not be repeated again in complete detail as a matter of convenience particularly where such detail is obvious from the drawing FIG. 10 and to those skilled in the art. The magazine release 70 of FIG. 10 with a single right hand side manual actuate button 53'' is fixed in place in pistol receiver 49'' by magazine catch body 24'', inserted from right side of the pistol, having body shoulder 30' abut receiver shoulder 55 and tightened thereagainst by washer 71 and screw 72 tightened into threaded opening 73 in body 24''. With this embodiment the tip 36'' is merely an alignment device for guided relative movement along slot 38' in body 24'' and is so shortened as to always be entirely within the profile of catch body 24'' and therefore the pistol receiver 49'' does not require any retrofit machining such as groove 54 of the other embodiment although it may be installed in a pistol receiver so altered and work just as effectively as in unaltered receiver 49''. Operation of this embodiment for magazine release is a duplicate of the operation as described for the ambidextrous magazine release 21' as related to the right hand side button 53 operation as described in relation to, and depicted in FIG. 6.

Whereas this invention has been described with respect primarily to one embodiment thereof, it should be realized that various changes may be made without departing from the essential contributions to the art made by the teachings hereof.

We claim:

1. A magazine release for a semi automatic gun including: a magazine catch lock release structure with, a catch body having a longitudinally extended opening, a catch lock release member having a body slidably received in said longitudinally extended opening of said magazine catch body, resiliently compressable spring means held in said longitudinally extended opening resiliently compressed between said magazine catch body and said catch lock release member when said magazine catch lock release structure is inserted in and restrained in place in a gun receiver and a magazine cam surfaced catch locking lever pivotally mounted on said magazine catch body; said catch locking lever including tip means engaging said catch lock release member for movement of the lever tip means with longitudinal movement of said catch lock release member relative to said magazine catch body; said catch locking lever also having a lock paw moveable into and out of a catch slot provided in a magazine with pivot movement of said locking lever; a cam surface of said locking lever rides over a surface of a magazine being inserted into the gun receiver until the magazine catch slot comes into locking alignment with said lock paw that is then snapped into locking engagement in the magazine catch slot as urged by said spring moving said catch lock release member and pivoting the lever for such cam lock action; and with said catch lock release member manually moveable inward against the resilient force of said spring to pivot said lever for catch lock release of the lever lock paw from said catch slot for magazine release.

2. The magazine release for a semi automatic gun of claim 1, wherein a groove is provided in the body of said catch lock release member for receiving said tip means of said catch locking lever; and with said tip means at one end of said catch locking lever and with said lock paw of said catch locking lever extended from a portion of said catch locking lever on the other side of the pivotal mounting of the lever on said magazine catch body from the side of said tip means.

3. The magazine release for a semi automatic gun of claim 2, wherein said magazine catch body is provided with a slotted extension; and a pivot pin is extended through said slotted extension and said catch locking lever as the pivotal mounting of the lever.

4. The magazine release for a semi automatic gun of claim 3, wherein said magazine catch body has a cut out providing clearance for the rounded front of a magazine when the release is in place in the receiver of a gun.

5. The magazine release for a semi automatic gun of claim 4, wherein said catch release member includes an external first button for manual magazine release actuation in moving said catch lock release member manually inward against the resilient force of said spring pivoting said lever for catch lock release of the lever lock paw from the magazine catch slot.

6. The magazine release for a semi automatic gun of claim 5, wherein outer direction movement limit means presents a limit barrier to outward movement of said catch lock release member.

7. The magazine release for a semi automatic gun of claim 6, wherein said outer direction movement limit means is the pivot limit contact of said catch locking lever with said catch body, and said tip means of the lever engaging a side of said groove in the body of said lock release member.

8. The magazine release for a semi automatic gun of claim 7, wherein magazine release gun receiver restraining means is provided including, a shoulder on said catch body engaging a shoulder in a receiver magazine release opening extended transversely through the gun receiver; and a screw and washer with the screw threaded into said catch body to tighten the washer against an outer surface of gun receiver.

9. The magazine release for a semi automatic gun of claim 7, wherein said external first button for manual magazine release actuation in moving said catch lock release manually inward extends outward from the right hand side of the gun receiver.

10. The magazine release for a semi automatic gun of claim 9, wherein said catch body includes a second button on a button extension with the second button external to the left hand side of the gun receiver; and a lock tip is provided on said catch lock release member that projects into a groove in said gun receiver to limit movement of said catch lock release member toward the right when the magazine release is installed for operation in a gun receiver.

11. The magazine release for a semi automatic gun of claim 10, wherein said longitudinally extending opening in said catch body is eccentrically positioned in said catch body in transverse alignment with said slotted extension.

12. The magazine release for a semi automatic gun of claim 11, wherein said catch body is provided with a radially extended slot and a longitudinally extended slot guiding longitudinal movement of said lock tip with relative longitudinal movement between said catch body and said catch lock release member; and with said radially extended slot being of sufficient extent to permit rotative movement of said lock tip to an unlock position where it does not extend out beyond the profile of the outer surface of the catch body and to a receiver retaining lock state in alignment with said longitudinally extended slot.

13. The magazine release for a semi automatic gun of claim 12, wherein said radially extended slot is positioned longitudinally inward from an outermost open end of said longitudinally extended slot so that the catch body and the catch lock release member must be moved closer together against the resilient resistive force of said spring means to bring said lock tip into alignment with said radially extended slot to permit rotation of the lock tip with said catch lock release member to the unlock position for magazine release removal from a gun receiver and reinsertion therein.

14. The magazine release for a semi automatic gun of claim 13, wherein a gun receiver retrofit slot cut is provided to permit longitudinal movement of said lock tip with inward movement of said catch release member for manual magazine release actuation from the right hand gun receiver side of an ambidextrous magazine release installed.

15. A semi automatic gun ambidextrous magazine release comprising: a catch body having an eccentrically positioned longitudinally extended opening; a catch lock release member having a longitudinally extended body portion slidably received in said longitudinally extended opening in said catch body; resiliently compressable spring means contained within said longitudinally extended opening resiliently urging said catch body and said catch lock release member apart; a magazine catch locking lever pivoted on said catch body and connected to said catch lock release member for pivotal movement of said lever into and out of magazine catch locked engagement with relative longitudinal movement between said catch body and said catch lock release member.

16. The semi automatic gun ambidextrous magazine release of claim 15, wherein a groove is provided in the body portion of said catch lock release member for receiving an end of said magazine catch locking lever; with said end of said catch locking lever on one side of the pivotal mounting of said lever and with a lock paw extended from a portion of said catch locking lever on the other side of the pivotal mounting of the lever on said magazine catch body.

17. The semi automatic gun ambidextrous magazine release of claim 16, wherein said magazine catch body is provided with a slotted extension; and a pivot pin is extended through said slotted extension and said catch locking lever as the pivotal mounting of the lever.

18. The semi automatic gun ambidextrous magazine release of claim 17, wherein said magazine catch body has a cut out providing clearance for the rounded front of a magazine when the release is in place in the receiver of a gun and for magazine release movement of said magazine catch body.

19. The semi automatic gun ambidextrous magazine release of claim 18, wherein said catch release member includes an external first button for manual release actuation in moving said catch lock release member manually inward against the resilient force of said spring pivoting said lever for catch lock release of the lever lock paw from magazine catch locked engagement; and wherein outer direction movement limit means presents a limit barrier to outward movement of said catch lock release member; with said outer direction movement limit means being the pivot limit contact of said catch locking lever with said catch body, and said end of the lever engaging a side of said groove in the body of said lock release member; said external first button for manual magazine release actuation in moving said catch lock release manually inward extends outward from a first side of the gun receiver; said catch body includes a second button extension with a second button external to the second side of the gun receiver; and a lock tip is provided on said catch lock release member that projects into a groove in said gun receiver to limit movement of said catch lock release member toward the right when the magazine release is installed for operation in a gun receiver.

20. The semi automatic gun ambidextrous magazine release of claim 19, wherein said eccentrically positioned longitudinally extended opening in said catch body is eccentrically positioned in said catch body in transverse alignment with said slotted extension.

21. The semi automatic gun ambidextrous magazine release of claim 20, wherein said catch body is provided with a radially extended slot and a longitudinally extended slot guiding longitudinal movement of said lock tip with relative longitudinal movement between said catch body and said catch lock release member; and with said radially extended slot being of sufficient extent to permit relative movement of said lock tip to an unlock position where it does not extend out beyond the profile of the outer surface of the catch body and to a receiver retaining lock state in alignment with said longitudinally extended slot.

22. The semi automatic gun ambidextrous magazine release of claim 21, wherein said radially extended slot is positioned longitudinally inward from an outermost open end of said longitudinally extended slot so that the catch body and the catch lock release member must be moved closer together against the resilient resistive force of said spring means to bring said lock tip into alignment with said radially extended slot to permit rotation of the lock tip with said catch lock release member to the unlock position for magazine release removal from a gun receiver and reinsertion therein.

23. The semi automatic gun ambidextrous magazine release of claim 22, wherein a gun receiver retrofit slot cut is provided to permit longitudinal movement of said lock tip with inward movement of said catch release member for manual magazine release actuation from the right hand gun receiver side of an ambidextrous magazine release installed.

* * * * *